United States Patent [19]

Watanabe

[11] 4,091,539

[45] May 30, 1978

[54] SCISSORS

[75] Inventor: Tokuji Watanabe, Yokkaichi, Japan

[73] Assignee: Hayashi Cutlery Company, Limited, Japan

[21] Appl. No.: 789,867

[22] Filed: Apr. 22, 1977

[51] Int. Cl.[2] ..... B26B 13/20

[52] U.S. Cl. ..... 30/341

[58] Field of Search ..... 30/254, 255, 256, 257, 30/258, 259, 260, 341; 76/104 A

[56] References Cited

U.S. PATENT DOCUMENTS 3,840,990 10/1974 Laurenti ..... 30/341

*Primary Examiner*—Jimmy C. Peters

*Attorney, Agent, or Firm*—George B. Oujevolk

[57] ABSTRACT

Scissors comprising a pair of scissor pieces, each comprising a blade portion and a holding portion extended from the blade portion and having a finger-hanging hole and said blade portion and holding portion being integrally formed by press molding, a pin connecting said scissor pieces substantially at central portions thereof so that the scissoring operation is possible, a pair of annular projecting members fitted in the finger-hanging hole from both the sides of the holding portion of each scissor piece so that the projecting members cover the inner peripheral edge of the finger-hanging hole and they co-operatively form a continuous inner peripheral wall portion, and an engaging member for holding said protecting members in the state fitted in each finger-hanging hole.

5 Claims, 10 Drawing Figures

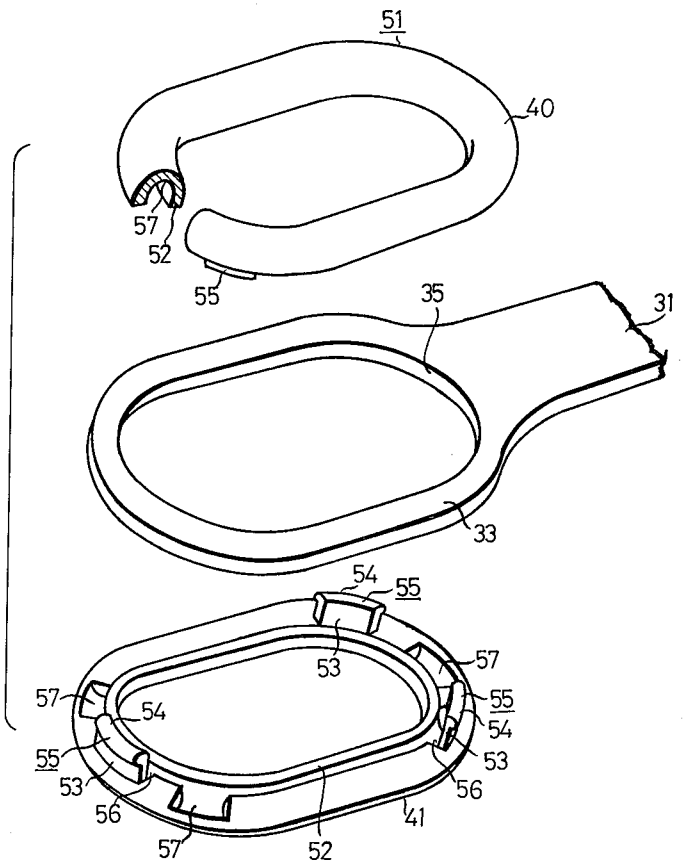
FIG. 8
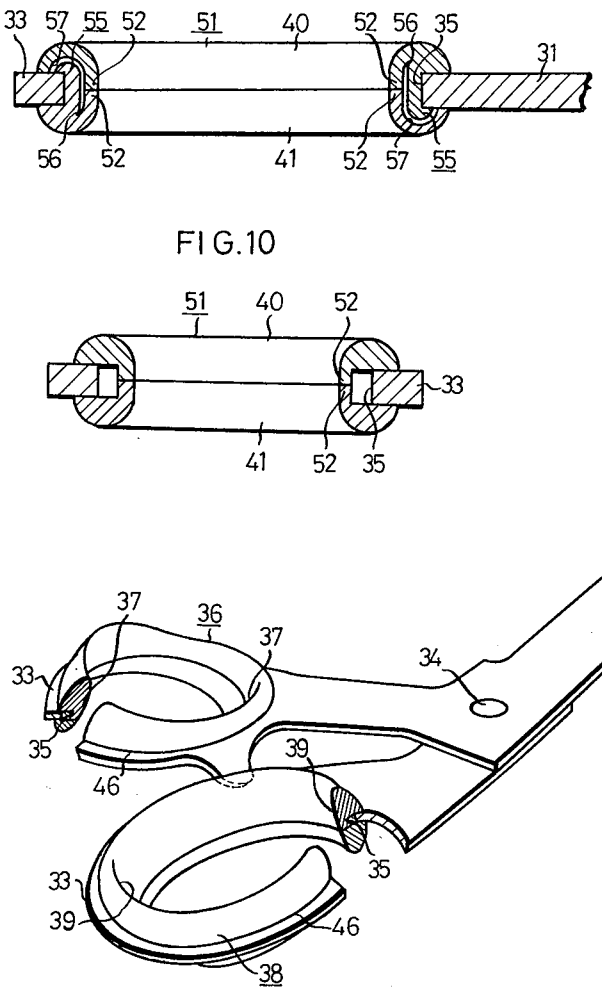
FIG. 7
FIG. 9
FIG. 10

SCISSORS

FIELD OF THE INVENTION

The present invention relates to scissors.

OBJECTS OF THE INVENTION

It is a primary object of the present invention to provide scissors which are strong and can be prepared very simply by forming integrally a blade portion and a holding portion constituting each scissor piece by press molding.

Another object of the present invention is to provide scissors in which a protecting member attached to each finger-hanging hole has a protecting effect of protecting fingers from the inner peripheral edge portion of the finger-hanging hole and a decorative effect.

Still another object of the present invention is to provide scissors in which a pair of protecting members are attached to a holding portion of each scissor piece from both the sides of the holding portion, whereby attachment of the protecting members can be facilitated, they can be attached strongly and tightly and the manufacturing cost of the scissors as a whole can be lowered.

A further object of the present invention is to provide scissors in which of an inner peripheral wall portion of a protecting member attached to each scissor piece, the part located on the side of a blade edge of the scissor piece and the part located on the opposite side are inclined in the same direction, whereby the scissors can be used conveniently by both left-handed and right-handed persons.

Other objects of the present invention will be apparent from embodiments described hereinafter and be clarified by the appended claims. Further, various advantages not mentioned in the specification will be apparent to those skilled in the art when they work the present invention.

SUMMARY OF THE INVENTION

In accordance with the present invention, the foregoing and other objects can be attained by scissors comprising a pair of scissor pieces, each comprising a blade portion and a holding portion extended from the blade portion and having a finger-hanging hole and said blade portion and holding portion being integrally formed by press molding, a pin connecting said scissor pieces substantially at central portions thereof so that the scissoring operation is possible, a pair of annular protecting members fitted in the finger-hanging hole from both the sides of the holding portion of each scissor piece so that the protecting members cover the inner peripheral edge of the finger-hanging hole and they co-operatively form a continuous inner peripheral wall portion, and an engaging member for holding said protecting members in the state fitted in each finger-hanging hole.

BRIEF DESCRIPTION OF THE DRAWING

FIG. 7 is a partially cut-out perspective view showing tailor's scissors for a left-handed person according to another embodiment of the present invention.

FIG. 8 is a fragmentary perspective view of a finger-hanging portion according to still another embodiment of the present invention.

FIGS. 9 and 10 are sectional views showing the finger-hanging portion shown in FIG. 8.

DETAILED DESCRIPTION OF THE PREFERRED EMBODIMENTS

Tailor's scissors for a right-handed person according to one embodiment of the present invention will now be described by reference to FIGS. 1 to 6.

Figure 1:
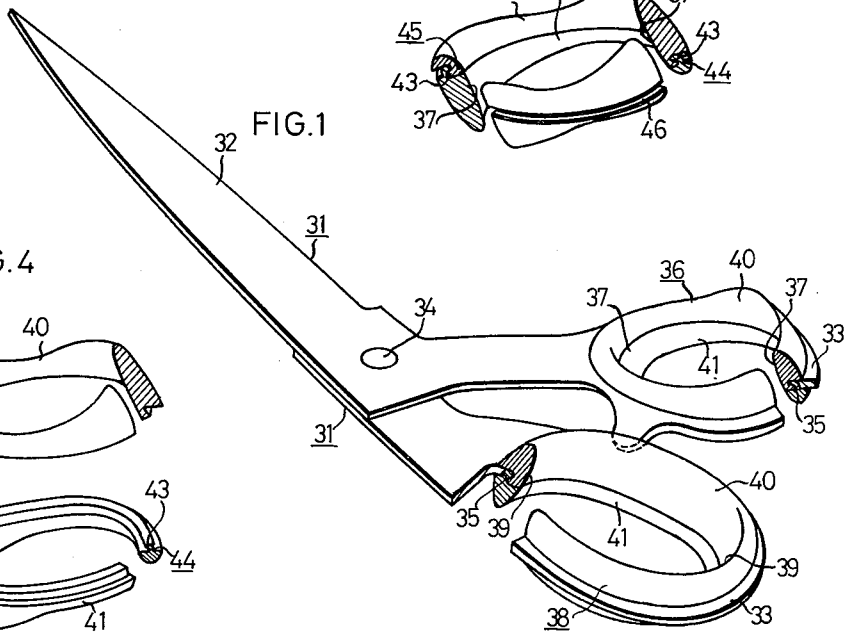
FIG. 1 is a partially cut-out perspective view showing tailor's scissors for a right-handed person according to one embodiment of the present invention.
Figure 4:
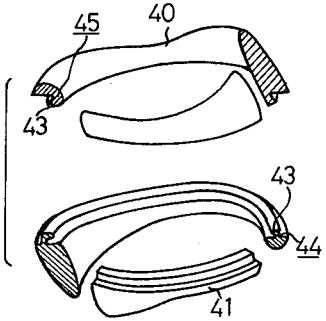
FIG. 4 is a partially cut-out fragmentary view of the thumb-hanging portion shown in FIG. 2.

Referring now to FIG. 1, each of a pair of scissor pieces 31 comprises a blade portion 32 and a holding portion 33 formed integrally with the blade portion 32 by press molding in an extended part of the blade portion 32. Both the scissor pieces 31 are connected to each other substantially at central portions thereof by means of a pin 34 so that the scissoring operation is possible. Since the blade portion 32 and holding portion 33 of each scissor piece 31 are integrally formed by press molding, there is no seam between the blade portion 32 and holding portion 33. Therefore, the scissors are excellent with respect to the strength over scissors formed by combining blade and holding portions prepared independently and the scissors of the present invention can be used for a long time. Moreover, since each scissor piece is integrally formed, the welding step can be omitted and manufacture of scissor pieces can be remarkably facilitated.

An elliptical finger-hanging hole 35 extending in the lengthwise direction of the scissors is formed through the holding portion 33 of each scissor piece 31. To one of the finger-hanging holes 35, an annular thumb-hanging member 36 is attached so that it covers the inner peripheral edge of said finger hanging hole 35. The parts of the inner peripheral wall located on both the ends of the finger-hanging member 36 in the lengthwise direction thereof are inclined so that the finger-projecting side is directed to the top end of the scissors, whereby an inclined face 37 is formed. Another finger-hanging member 38 for insertion of four fingers other than the thumb is attached to the other finger-hanging hole 35 to cover the inner peripheral portion of the hole 35. The parts of the inner peripheral wall located on both the ends of the finger-hanging member 38 in the lengthwise direction thereof are inclined to form an inclined face 39 inclined in a direction reverse to the inclination direction of said inclined face 37. Each of the finger-handing members is composed of a synthetic resin.

If such inclined faces 37 and 39 are formed on the inner walls of the finger-hanging members 36 and 38, the inclination directions of these faces 37 and 39 are in agreement with the direction of insertion of the thumb and that of insertion of other four fingers, respectively, and the scissors can be gripped in good conditions.

Figure 2:
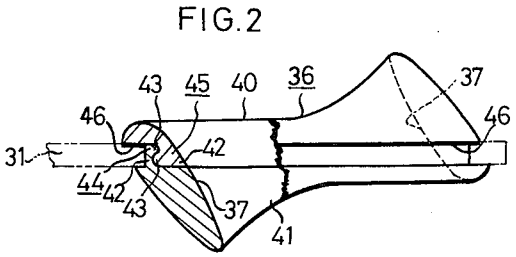
FIG. 2 is a partially cut-out front view of a thumb-hanging portion of the scissors shown in FIG. 1.
Figure 3:
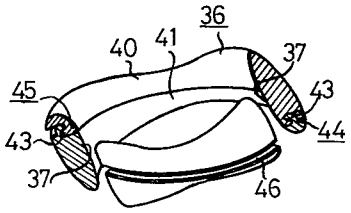
FIG. 3 is a perspective view of the thumb-hanging portion shown in FIG. 2.
Figure 5:
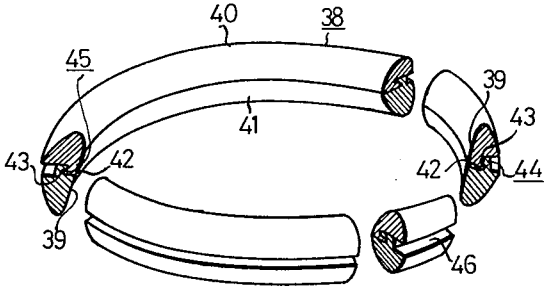
FIG. 5 is a partially cut-out front view of a four-finger-hanging portion of the scissors shown in FIG. 1.
Figure 6:
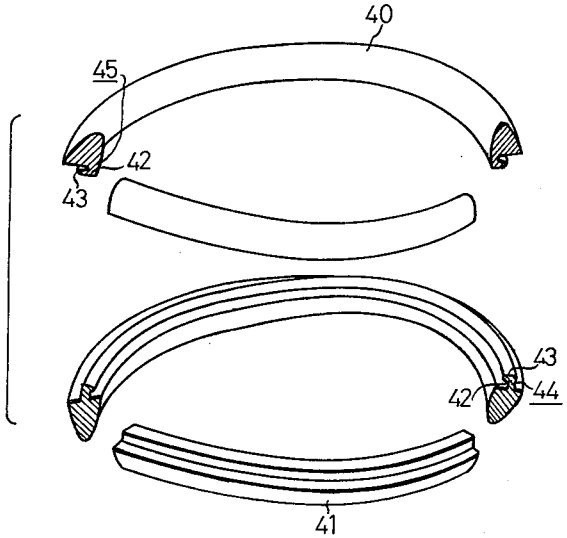
FIG. 6 is a partially cut-out fragmentary perspective view of the four-finger-hanging portion shown in FIG. 5.

As shown in FIGS. 2 and 5, each of the finger-hanging members 36 and 38 comprises a pair of upper and lower protecting members 40 and 41 engaged with each other in the finger-hanging hole 35 of each scissor piece 31. An annular butting portion 42 is projected integrally with the lower protecting member 41 substantially at the central portion thereof along the entire circumference thereof, and an anchoring inward projection 43 is integrally formed on the top end of the butting portion 42. An engaging projection 44 is constructed by these butting portion 42 and anchoring projection 43. A butting portion 42 same as mentioned above is formed along the entire peripheral edge of the lower face of the upper protecting member 40, and an anchoring outward projection 43 is formed on the top end of the butting portion 42. An engaging projection 45 to be engaged with the engaging projection 44 of the lower protecting member 41 from the inner side thereof is constructed by these butting portion 42 and anchoring projection 43. In this embodiment, the inner wall portion of each of the finger-hanging members 36 and 38 having inclined faces 37 and 39 is defined by the butting portion 42 of the upper protecting member 40 and the inner peripheral face of the lower protecting member 41.

Accordingly, both the protecting members 40 and 41 are attached to each scissor piece 31 very simply by fixing the upper and lower protecting members 40 and 41 to the upper and lower faces of the holding portion 33 of the scissor piece 31 so that the respective engaging projections 44 and 45 are fitted in the finger-hanging hole 35 and pressing both the engaging projections 44 and 45 to each other so that both the anchoring projections 43 are engaged with each other by their own elasticity. This attachment operation can be accomplished very simply and assuredly without any substantial trouble, and therefore, the manufacturing cost of scissors can be reduced. Further, when such finger-hanging members 36 and 38 are attached, the inner peripheral edge portion of the finger-hanging hole 35 is appropriately covered with the finger-hanging members 36 and 38, and these finger-hanging members 36 and 38 exert a cushioning effect and a decorative effect and a user can operate the scissors very comfortably.

If both the protecting members 40 and 41 are attached in the foregoing manner, a fitting groove 46 for fitting therein the inner peripheral edge portion of the finger-hanging hole 35 of the scissor piece 31 is formed on the outside of the butting portion 42 of the lower protecting member 41, and the fitting groove 46 is located on a line dividing the corresponding finger-hanging member 36 or 38 into upper and lower halves.

The above arrangement may be adopted conveniently to scissors for a left-handed person by making the inclination directions of the inclined faces 37 and 39 of the finger-hanging members 36 and 38 with the directions of insertion of the thumb and other four fingers of a left hand as shown in FIG. 7.

In the foregoing embodiment, the anchoring projection 43 is disposed to expand from the top end of the butting portion 42 along the entire periphery thereof. Of course, non-anchoring parts free of the anchoring projection 43 may be formed at confronting positions. In this case, the operation of fitting the upper and lower protecting members 40 and 41 can be further facilitated.

Another embodiment of the scissors of the present invention will now be described by reference to FIGS. 8 to 10, in which members same as or similar to those shown in FIGS. 1 to 7 are represented by the same reference numerals. These same or similar members are not particularly explained but different members alone are described in detail.

A pair of upper and lower protecting members 40 and 41 of a finger-hanging member 51 have confronting annular butting portions 52 along the entire peripheral edge portion of the lower and upper faces of the protecting members 40 and 41, respectively. The height of each butting portion 52 corresponds substantially to a half of the thickness of the holding portion 33 of the scissor piece 31. Accordingly, when the protecting members 40 and 41 are attached, the butting portions 52 of these protecting members 40 and 41 constitute the inner peripheral wall of the finger-hanging member 51. Three projections 53 having a height slightly larger than the thickness of the holding portion 33 are formed on the slightly outside part of the butting portion 52 of each of the protecting members 40 and 41. An anchoring outward projection 54 is formed on the top end of each projection 53. The projection 53 of the upper protecting member 40 and the projection 53 of the lower protecting member 41 are displaced at such positions that they do not collide with each other. An engaging projection 55 to be engaged with the inner peripheral edge of the finger-hanging hole 35 of the holding portion 33 is constructed by said projection 53 and anchoring projection 54. Notches 56 are formed on the side faces of the protecting members 40 and 41 between the engaging projections 55 and butting portions 52 so that when the engaging projections 55 are fitted to the finger-hanging hole 35, these engaging projections 55 can easily be moved in the state curved inwardly. Recesses 57 for receiving therein the top ends of the confronting engaging projections 55 of the protecting members 40 and 41 are formed on the confronting faces of the upper and lower protecting members 40 and 41.

In the above arrangement, when both the upper and lower protecting members 40 and 41 are attached to the holding portion of the scissor piece 31, if the engaging projections 55 of the protecting members 40 and 41 are pressed into the finger-hanging hole 35 of the holding portion 33 from both the upper and lower sides thereof, respectively, the engaging projections 55 hit on the inner peripheral edge of the finger-hanging hole 35 and moved in the state curved inwardly. Thus, the engaging projections 55 pierce the finger-hanging hole 35 toward the opposite side and then restored by their own elasticity, and they are anchored on the inner peripheral edge of the finger-hanging hole 35. Accordingly, both the protecting members 40 and 41 can easily be attached to the holding portion 33. Since the protecting members 40 and 41 are independently fitted and fixed to the inner peripheral edge of the finger-hanging hole 35 in the foregoing manner through their own engaging projections 55, in this embodiment attachment of the protecting members 40 and 41 can be accomplished more assuredly than in the case where the protecting members 40 and 41 are attached in such a manner that they grip the holding portion 33 from both the sides thereof, and separation or falling-out of the protecting members 40 and 41 can be completely prevented. Further, the notch 56 is formed on the base end portion of each engaging projection 55, it can easily be curved inwardly when it is fixed to the holding portion 33.

In the state where both the protecting members 40 and 41 are attached in the foregoing manner, their butting portions 52 hit on each other in the engaged condition in the finger-hanging hole 35 and the top ends of their engaging projections 55 are inserted in the confronting recesses 57 of the protecting members 40 and 41.

As will be apparent from the foregoing illustration, according to the present invention, a pair of protecting members are attached to the holding portion of each scissor piece from both the sides thereof, whereby they can be attached very easily and strongly and the manufacturing cost of scissors as a whole can be reduced accordingly.

The present invention has been described hereinbefore in detail by reference to most preferred embodiments thereof, but as will be apparent to those skilled in the art, various other embodiments and modifications may be made within the spirit and scope of the present invention. For example, an adhesive may be used for attaching upper and lower protecting members 40 and 41 to the holding portion 33 of each scissor piece 31, or finger-hanging members 36, 38 and 51 may be made from a rubbery material according to a suitable molding method. Thus, the present invention is not limited to the specific illustrations except to the extent defined in the following claims.

I claim:

1. In a scissors having a pair of scissor pieces, each with a blade portion and a holding portion extending from the blade portion and having a finger-hanging hole, said blade portion and holding portion being integrally formed by press molding, a pin connecting said scissor pieces substantially at central portions thereof so that the scissoring operation is possible, a pair of annular protecting members fitted in the finger-hanging hole from both the sides of the holding portion of each scissor piece so that the protecting members cover the inner peripheral edge of the finger-hanging hole and they co-operatively form a continuous inner peripheral wall portion, and engaging means for holding said protecting members into each finger-hanging hole, the improvement therein, wherein, said engaging means are engaging projections projected from the pair of the protecting members in directions confronting each other so that they are engaged with the inner peripheral edge of the finger-hanging hole, and, each of said engaging projections comprises a plurality of projections formed on parts of the inner peripheral edge portion of the protecting member and anchoring projections projected outwardly from the top ends of said projections.

2. Scissors as set forth in claim 1 wherein recesses are formed on the inner peripheral edge portion of each protecting member so that the top ends of the engaging projections of the confronting protecting member are inserted in said recesses.

3. Scissors as set forth in claim 1 wherein the inner peripheral wall portions of the protecting members are constructed by annular butting portions projected in directions confronting each other along the entire circumferences of the protecting members inwardly of said engaging means.

4. Scissors as set forth in claim 1 wherein notches are formed on the confronting side faces of the protecting members on the inner sides of said engaging projections so that curved and inclined inward movement of each of said engaging projections can be facilitated.

5. Scissors as set forth in claim 1 wherein in the inner peripheral wall portion of each of the protecting members, the part located on the side of a blade edge of the scissor piece and the part confronting to said part are inclined in the same direction.

* * * * *